United States Patent [19]

Lagin

[11] Patent Number: 4,693,369

[45] Date of Patent: Sep. 15, 1987

[54] CLOTHES HANGING SYSTEM AND THEFT-PROOF SHIPPING SYSTEM

[76] Inventor: Herbert Lagin, 31 Deer Park Rd., Great Neck, N.Y. 11024

[21] Appl. No.: 880,341

[22] Filed: Jun. 25, 1986

Related U.S. Application Data

[63] Continuation of Ser. No. 627,492, Jul. 6, 1984, abandoned.

[51] Int. Cl.[4] ..... B65D 85/18

[52] U.S. Cl. ..... 206/290; 206/289; 206/300; 206/298

[58] Field of Search ..... 206/284, 285, 289, 290, 206/291, 294, 296, 298, 300

[56] References Cited

U.S. PATENT DOCUMENTS

| | | | |
|---|---|---|---|
| 994,419 | 6/1911 | Metzger | 206/290 |
| 1,569,982 | 1/1926 | Kapriglian | 206/290 |
| 1,717,078 | 6/1929 | Wheary | 206/290 |
| 1,843,547 | 2/1932 | Dukes et al. | 206/290 |
| 1,861,845 | 6/1932 | Dukes et al. | 206/290 |
| 2,086,895 | 7/1937 | Cart | 206/289 |
| 2,526,142 | 10/1950 | Koch | 206/290 |
| 3,191,770 | 6/1965 | Zuckerman | 206/300 |
| 3,337,030 | 8/1967 | Miller et al. | 206/290 |
| 3,421,614 | 1/1969 | Crane | 206/290 |
| 4,193,482 | 3/1980 | Koff | 206/290 |

FOREIGN PATENT DOCUMENTS

| | | | |
|---|---|---|---|
| 568744 | 11/1957 | Italy . | |
| 209398 | 11/1966 | Sweden | 206/290 |

*Primary Examiner*—Joseph Man-Fu Moy
*Attorney, Agent, or Firm*—Schweitzer & Cornman

[57] ABSTRACT

A clothes hanging system for shipping pre-hung garments. A hanger is provided with a central hole or aperture. During shipping, a rod passes through opposed walls of the shipping carton and through the holes of the hangers. In this manner, the garments and hangers will not become accidentally dislodged, during shipment, from the horizontal support rod. Upon receipt of the shipping container, the hangers are slid off the rod and the hooks of the hangers placed on the store's clothing racks.

1 Claim, 4 Drawing Figures

CLOTHES HANGING SYSTEM AND THEFT-PROOF SHIPPING SYSTEM

This is a file wrapper continuation application of application Ser. No. 627,492, filed July 6, 1984, now abandoned.

BACKGROUND OF THE INVENTION AND DESCRIPTION OF THE PRIOR ART

The present invention relates to a system for hanging clothing in a manner such that the hangers holding the pre-hung clothing, when shipped from a manufacturer of the clothing to a retailer, in bulk, will not fall off the support rod for the hangers and, in addition, the hangers can be easily placed on the clothing rods in the retail establishment for displaying the clothing for sale, in the usual manner.

More specifically, manufacturers of clothing, for example, dresses, blouses, skirts, etc. ship large quantities of pre-hung clothing, i.e., already on hangers, in cartons to the retail establishments which have purchased the clothing for ultimate resale to retail customers. The bulk shipping of the pre-hung clothing is, upon receipt by the retail establishment, removed from the carton and immediately placed on the clothing rods in the retail establishment for display and sale purposes. The present invention thus allows for pre-hung clothing to be shipped and, in addition, eliminates the otherwise present possibility of the hangers and clothing falling off the support rod, during shipping, and being received in a creased condition and in disarray.

Manufacturers of clothing are often required to ship their finished clothing products in a pre-hung fashion. That is, the retail establishments which purchase the garments, in bulk, require that the garments be received on hangers which can then be easily placed on the horizontal extending clothing support rods in the retail establishments for ultimate display and sale purposes to the consuming public. In this manner, the retailer doesn't receive the garments in a folded condition and then spend time placing the garments on hangers before hanging the garments for sale.

The manufacturers of the clothing have, heretofore, in order to deliver pre-hung garments, placed their garments on ordinary hangers, which hangers have then been placed on horizontal support rods in cartons. The cartons, after being filled with the bulk goods, are then sealed and delivered to the retailers. Upon receipt, the retailers have, heretofore, opened the cartons with the intention of removing the pre-hung clothing and immediately placing the pre-hung garments on the retail store's clothing support rods.

The prior method of shipping pre-hung clothing, just described, suffers from several disadvantages. Since the cartons, full of clothing, are handled by shippers in an often cavalier or careless fashion, the cartons have been turned in many directions, i.e., they are not always maintained with the proper top side facing up and, therefore, the hangers, with the clothing, frequently become dislodged from the horizontal hanger support rods of the carton. Thus, when the cartons are opened by the retail establishments, many of the garments, while still on the hangers, are not on the horizontal hanger support rods but, rather, are in total disarray on the floor of the carton. Obviously, this is a result to be avoided since it results in creased clothing, difficultly in transferring the pre-hung garments from the carton to the retailer's hanger support rods and, in addition, causes the previously sized and sorted garments to be in total disarray, thereby necessitating a resorting of the garments prior to being hung on the retailer's hanger support rods. Thus, maintaining the hangers on the carton support rod, during shipping, is a desirable result.

SUMMARY OF THE PRESENT INVENTION

The present invention allows for the bulk shipping, in cartons, of pre-hung garments, as desired by retailers and, in addition, eliminates the hangers from becoming accidentally displaced, during shipping, from the horizontal support rod of the shipping cartons. In this manner, the garments are bulk-shipped in a pre-hung fashion, so that, upon receipt by the retail establishment, the clerks of the retail establishment can simply open the carton, remove the pre-hung garments and easily and instantly place them on the horizontal support rods of the retailer. This, according to the present invention, can be accomplished in a manner such that the garments are not creased by becoming lodged on the bottom of the carton during shipment and are still in the same prearranged order as originally placed in the carton by the manufacturer.

The present invention contemplates the use of a hanger having the normal garment supporting shoulder portions and the otherwise normal hanger hook which is adapted to be supported by the retailer's horizontal support rod. In addition, however, the hangers of the present invention are provided with a hole or aperture passing through the neck portion of the hanger which aperture selectively receives a horizontal support rod of the shipping carton and holds the hanger in place during shipment.

In this manner, the garment is supported by the hanger, in turn supported on the horizontal support rod passing through the hole of the hanger in the shipping carton and, upon receipt by the retailer, the hanger can be removed from the carton's horizontal support rod, by withdrawing the rod from the aperture of the hanger and, then, the hanger's otherwise conventional supporting hook can be placed on the horizontal support rods of the retail establishment, in the normal manner.

In another embodiment of the present invention, the aperture or hole of the hanger, through which the carton support rod passes, is provided with a flat edge and the cross section of the carton support rod is matingly shaped to the configuration of the aperture, such that the hangers, with the garments supported thereon, during shipment, will always be maintained in a fixed relation to the carton support rod and the walls of the carton. In effect, the hangers will always be maintained in a fixed orientation to the shipping carton because of the "keyed" relationship between the aperture of the hangers and the carton support rod.

DETAILED DESCRIPTION OF THE INVENTION

Figure 1:
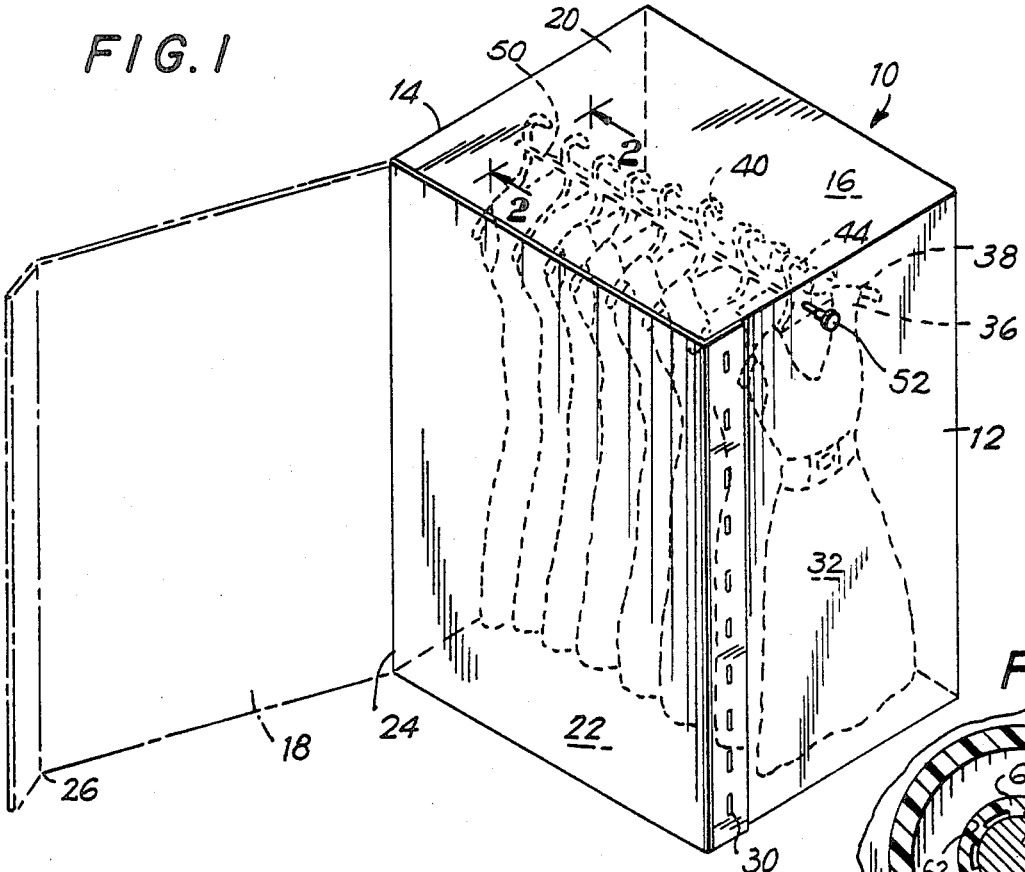
FIG. 1 is a perspective view of a shipping container, showing the hanger system of the present application supporting a plurality of garments (in this case, women's dresses) and ready for shipment to the retailer. The dotted lines indicate the position of the side door, both before sealing and after reopening.
Figure 4:
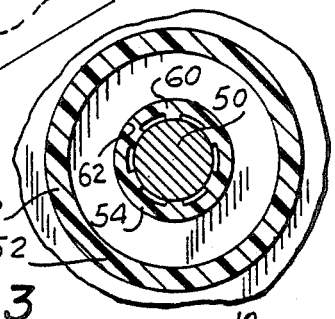
FIG. 4 is a cross sectional view taken along lines 4—4 of FIG. 3.
Figure 2:
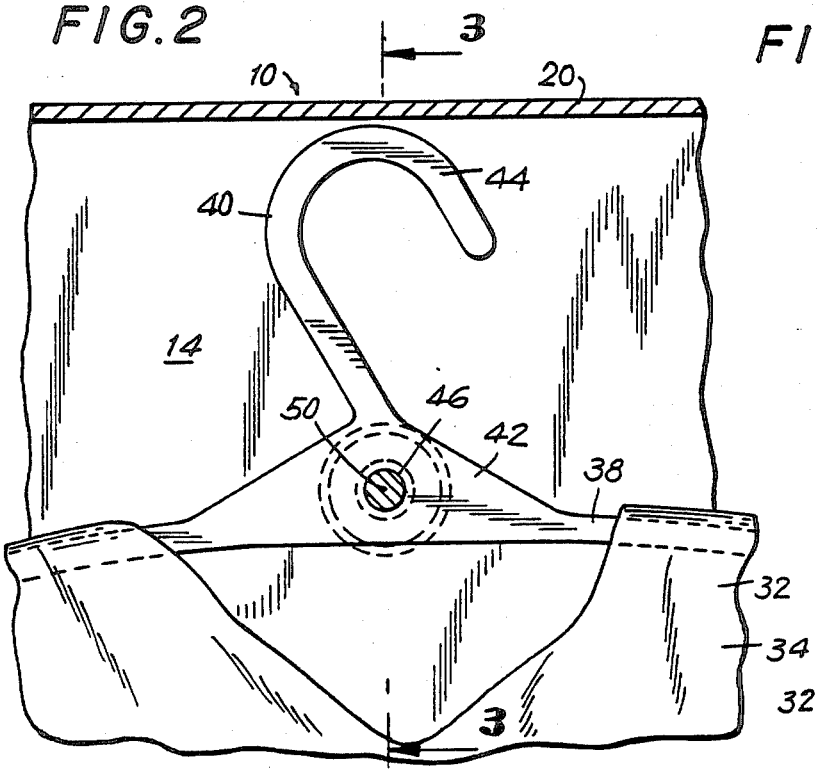
FIG. 2 is a cross sectional view taken along lines 2—2 of FIG. 1.
Figure 3:
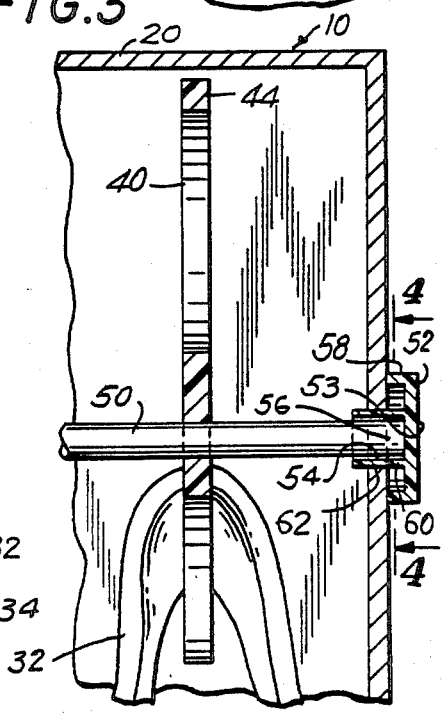
FIG. 3 is a cross sectional view taken along lines 3—3 of FIG. 2.

A shipping carton, generally referred to as 10, has front and rear walls 12 and 14, respectively, a side wall 16 and a side door 18. A top 20 and bottom 22 of the shipping carton are also provided in the embodiment of the present invention. The shipping carton 10 is made of cardboard material but, alternatively, it could be made from thin wood or other material which is protective of the clothing sought to be shipped. The side door 18 is hinged at 24 to the rear wall 14 and is provided, at its outside edge 26, with a sealing flap 28. After the garments 32 are loaded into the shipping container 10, the side door 18 is rotated about hinge 24 and the sealing flap 28, extending along the height of the front wall 12 and overlying front wall 12, is sealed thereto in a conventional manner. This sealing can be accomplished by stapling, taping or adhesive means in a well-known and conventional manner. Once the shipping carton 10 is sealed with the garments 32 located therein, the carton 10 is shipped from the manufacturer of the garments 32 to the retailer whereupon the door 18 is opened by removing staples 30, the preferred sealing means, which, during shipping, serve to secure the sealing flap 28 to the front wall 12.

For the purpose of illustrating the preferred embodiment of the present invention, a plurality of dresses 34 are shown in the drawings. A dress 34 is normally provided with shoulder straps 36 which, in a conventional manner, are supported by the shoulder portions 38 of a hanger 40. It will be appreciated, however, that the specific types of garments to be hung and shipped by the present invention and the configuration of the shoulder portions 38 or garment supporting portions of the hangers 40 can be modified without departing from the scope of the present invention. For example, slacks can also be shipped in a pre-hung fashion according to the present invention with a slack-holding horizontal bar of a hanger being used, in a conventional manner.

Hanger 40 has, as mentioned, shoulder portions 38, which support the garments 32, and a central neck portion 42, where the shoulder portions 38 of the hanger 40 centrally meet. Extending above the neck portion 42 is the hook 44 of the hanger 40, which is shaped and adapted to be placed on a horizontal hanger supporting rod (not illustrated), in the retail establishment, in a conventional manner. When hung in the retail establishment, a purchaser can easily remove the hanger 40 and garments 32 from the horizontal support rod in order to try on the garment or purchase it, or alternatively, can replace a hanger 40 with garment 32 thereon, back on the horizontal support rod for future display and sale purposes. This is all relatively conventional.

According to the preferred embodiment of the present invention, the neck portion 42 of the hanger 40 is provided with an aperture or hole 46. The aperture, according to the illustration, is circular and passes completely through the neck portion 42 of the hanger 40. The preferred embodiment of the present invention contemplates that the hangers are plastic and, therefore, the aperture 46 can easily be punched out or cut into the neck portions 42 of hangers 40. The hole could, alternatively, be replaced by two holes, each of which passes through the ends of the hanger's shoulder portions 38.

In an alternate embodiment of the present invention, the aperture 46 is provided with a flat edge 48 (not shown). The cross section of support rod 50, discussed hereinafter, will then correspond to the shape or outline of the hole 46. The shape of the aperture 46 and rod 50 thus serve to "key" the aperture 46 and hanger 40 onto the carton's horizontal support rod 50. In this manner, the hangers 40 and garments 32, after being supported by the carton's horizontal support rod 50, will be maintained in a fixed orientation to the walls 12–22 of the carton 10.

The horizontal support rod 50 is, in the preferred embodiment, merely a wooden cylindrical dowel which is long enough to extend and pass through the front and rear walls 12 and 14 of the carton 10. Support rod 50 is of the proper diameter to pass through the aperture 46 of hangers 40. In this manner, the horizontal support rod 50 of carton 10 passing through walls 12 and 14 and apertures 46 of the hangers 40 supports the hangers 40 and the garments 32, themselves supported on the shoulder portions 38 in the carton 10. In this manner, the garments are shipped to the retailer and the hangers 40 cannot become dislodged from the support bar 50.

End caps 52 serve to maintain the horizontal support rod 50 in place during shipment. The end caps 52 have outside faces 53 and are provided with a central hole 54 for receiving, in a frictionally engaged manner, the ends 56 of the horizontal support rod 50. That is to say, the central holes 54 of the end caps 52 can be easily placed over the ends 56 of the support rod 50 after they have been inserted through holes 62 of carton 10, to secure the rod 50 in place during packing and shipping. However, when the carton is unsealed at the retailer's place of business, the end caps 52 can be easily removed from the ends 56, so that the horizontal support rod 50 can be removed from the apertures 46 of the hangers 40, to thereby allow easy placement of hooks 44 on the clothing racks or horizontal support rods of the retail establishment. End caps 52 are provided with an annular ridge 58 which, when the end cap is placed on the horizontal support rod 50, abuts against the surface of the front and rear walls. The central hole 54 of the end caps 52 is defined by inner annular ridge element 60 which extends through holes 62 (properly aligned) cut through the front and rear walls 12 and 14.

To set up the carton for packing purposes, one end 56 of support rod 50 is passed, preferably from the outside of carton 10, through one of the holes 62 of carton 10. Then, the manufacturer of the garments, at his factory, slides the apertures 46 of the hangers 40 (with garments 32 attached and supported thereon) over the free end 56 of horizontal support rod 50 located on the inside of carton 10. Alternatively, the end 56 of the horizontal support rod 50 is slipped through the hole 62 from the inside of the carton 10 and then the hangers 40 and garments 32 are slid onto the support rod 50. Once all of the garments 32, supported by hangers 40, are slid upon the horizontal support rod 50, the free end 56 of the horizontal support rod 50 is slipped through the other hole 62 of carton 10. In this manner, both ends 62 of horizontal support rod 50 are supported by the walls 12 and 14 of carton 10. The ends 62 of horizontal support rod 50 are thus extended beyond the surfaces of walls 12 and 14.

End caps 52 are then placed through the holes 62 of carton 10 in such a manner that the ends 56 of rod 50 are received within the circularly shaped holes 54. The end caps 52 are than pushed against the walls of the carton until annular ridge 58 abuts against the walls. In this manner, it can be seen that the horizontal support rod is fixed in a position within carton 10 with hangers 40 and garments 32 suspended therefrom.

The side door 18 is then pivoted about hinge 24 and sealing flap 28 is folded against front wall 12. Staples 30 are applied to sealing flap 28 to secure it against front wall 12. As thus prepared, the garments 32 are ready for shipment from the manufacturer to the retailer. It can be seen that the garments 32 are shipped in a pre-hung fashion, ready for immediate hanging on the clothing racks or horizontal support rods of the retailer and, in addition, during shipment, the garments 32 and hangers 40 cannot become accidentally dislodged from their hanging position.

Upon receipt of the carton 10, containing garments 32, the retailer need only unseal the sealing flap 28 from the front wall 12 and open side wall 18. One or both of end caps 52 should then be removed from the ends 56 of the horizontal support rod. One end 56 of the horizontal support rod is then slowly removed from hole 62 of the carton 10. Individual garments 32 are then available for sliding off the rod 50 and for placement on the racks or horizontal support rods of the retailer to be supported by hooks 44. Alternatively, the rod, with hangers and garments suspended, can be carried to the clothing racks. The hooks 44 of the hangers can then be placed on the clothing racks. Once this is done, the horizontal support rod is removed from the apertures of the hangers.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A garment support system for both hanging and shipping garments in a creaseless manner and, after shipping, for hanging the garments on a conventional retail garment rack having a horizontal cylinder rod, comprising:

(a) a shipping carton having a pair of opposed side walls;

(b) a plurality of hangers each having (i) a hanger body with a pair of longitudinally extending shoulders for supporting a garment, (ii) a first hanger support means centrally located and connected to said hanger body comprising a conventional open-sided horizontal rod engaging supporting hook capable of being selectively secured to and detachable from said conventional retail garment rack, (c) a horizontally extending rigid, cylindrical support rod for providing complete load support and simultaneous theft prevention, during shipping of said hangers and garments in said shipping carton and wholly exclusive of support provided by said first hanger support means during shipping, said horizontal cylinder support rod being provided, at each end, with connection means for selectively attaching it to said side walls of said shipping carton, (d) each of said hangers having a second hanger support means mechanically independent from said first hanger support means, comprising an aperture passing through said hanger body, said second hanger support means being capable of selectively being supported by said horizontal cylinder support rod by being first passed through said aperture and attached to said side walls of said shipping carton by said connection means and serving to lock said hanger and said garment thereon to said horizontal cylinder support rod during shipping of a garment and to facilitate, after shipping, the renoval of all hangers and garments simultaneously from said shipping box and the placement of all hangers and garments, simultaneously, on said conventional retail garment rack, (e) said first hanger support means and said second hanger support means being alternatively usable at the same time without any physical alteration of said hanger or said first or second hanger support means, and (f) said hangers all being made from a single piece of material.

* * * * *